US008161572B1

(12) United States Patent
Rorke

(10) Patent No.: US 8,161,572 B1
(45) Date of Patent: Apr. 24, 2012

(54) THERMAL LAYER INSULATED CAPE EQUIPPED WITH A FLAP BODY

(76) Inventor: Fern A. Rorke, Banff (CA)

( * ) Notice: Subject to any disclaimer, the term of this patent is extended or adjusted under 35 U.S.C. 154(b) by 0 days.

(21) Appl. No.: 13/118,519

(22) Filed: May 30, 2011

(51) Int. Cl.
*A41D 13/04* (2006.01)

(52) U.S. Cl. ..... 2/50

(58) Field of Classification Search ..... 2/50, 88, 2/48, 49.1, 51, 52, 174, 49.4, 49.5, 87, 92, 2/104, 46
See application file for complete search history.

(56) References Cited

U.S. PATENT DOCUMENTS

| | | | | | |
|---|---|---|---|---|---|
| 569,540 | A * | 10/1896 | Carlton | 2/50 |
| 2,093,483 | A * | 9/1937 | Sackett | 2/50 |
| 2,717,389 | A * | 9/1955 | Gribble et al. | 2/50 |
| 2,744,252 | A * | 5/1956 | Cansler | 2/50 |
| 2,851,690 | A * | 9/1958 | Jennings | 2/50 |
| 2,947,004 | A * | 8/1960 | Pfile | 2/50 |
| 3,798,674 | A * | 3/1974 | Daniel | 2/50 |
| 4,280,227 | A * | 7/1981 | Brock | 2/88 |
| 4,615,047 | A * | 10/1986 | Matsuoka | 2/50 |
| 4,709,420 | A * | 12/1987 | Gettinger | 2/50 |
| 4,710,980 | A * | 12/1987 | Brison et al. | 2/50 |
| 6,195,799 | B1 * | 3/2001 | Davies | 2/50 |
| 6,868,554 | B1 * | 3/2005 | Melvin | 2/50 |
| 2004/0049828 | A1 * | 3/2004 | Moses | 2/50 |
| 2007/0074329 | A1 * | 4/2007 | Marshall et al. | 2/69 |

* cited by examiner

*Primary Examiner* — Amy Vanatta

(57) ABSTRACT

A thermal layer insulated cape that is equipped with a flap body can be fabricated by a cape body of substantially circular shape that has a center aperture for fitting around a user's neck, a slot opening from the aperture to one edge of the cape body for wrapping around a user's body; a top surface of the cape body formed of a water impermeable material, and a first fastener attached to the top surface juxtaposed to a first side of the slot opening; a bottom surface of the cape body formed of a thermal insulating material, and a second fastener matingly engageable with the first fastener attached to the bottom surface juxtaposed to a second side of the slot opening for engaging the first fastener; and a flap body extending outwardly away from the aperture for catching debris during a hair-care procedure.

6 Claims, 3 Drawing Sheets

THERMAL LAYER INSULATED CAPE EQUIPPED WITH A FLAP BODY

FIELD OF THE INVENTION

The present invention generally relates to a cape and more particularly, relates to a cape for use in beauty salons and barbershops that is thermally insulated.

BACKGROUND OF THE INVENTION

In beauty salons and barbershops, capes are always used to protect a customers clothing during the hair styling, spa, or hair cut process. However, the conventional cape is fabricated by a single piece of fabric which does not provide any thermal insulation effect, such as in a cold weather conditions. It is therefore desirable to provide an insulated cape that can be used for not only protecting a customers clothing but also provide warmth for the customer.

It is therefore an object of the present invention to provide a cape for use in a beauty salon or barbershop that does not have the drawbacks or shortcomings of the conventional capes.

It is another object of the present invention to provide an insulated cape that further provides thermal insulation to the person using the cape.

SUMMARY OF THE INVENTION

In accordance with the present invention, a thermally insulated cape for use in a beauty salon or barbershop is provided.

The present invention thermal layer insulated cape that is equipped with a flap body can be fabricated by a cape body of substantially circular shape that has a center aperture for fitting around a user's neck, a slot opening from the aperture to one edge of the cape body for wrapping around a user's body; a top surface of the cape body formed of a water impermeable material, and a first fastener attached to the top surface juxtaposed to a first side of the slot opening; a bottom surface of the cape body formed of a thermal insulating material, and a second fastener matingly engageable with the first fastener attached to the bottom surface juxtaposed to a second side of the slot opening for engaging the first fastener; and a flap body extending outwardly away from the aperture for catching debris during a hair-care procedure.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a thermal layer insulated cape that is also equipped with a flap body for use in beauty salons or barbershops.

The present invention thermal layer insulated cape is a newly designed hair salon cape that provides added warmth and comfort for the client. The present invention can be used in professional hairstyling salons and barbershops. The present invention is similar in shape and design to an existing nylon cape with a close tie in the back. However, the present invention features a cloth lining sewn inside to add warmth for the client while hair is shampooed, rinsed, cut, and styled. The present invention allows patrons to have peace of mind knowing that they will stay warm and comfortable during the shampooing, rinsing, and styling process. The cape measures 60 inches long and 54 inches wide in ova shape, or can be between 54-60 inches in diameter in circular shape and can be produced in various colors and styles.

The present invention thermal layer insulated cape fulfills the need for an effective means of keeping a client comfortable and warm while receiving various hairstyling serves. The appealing features of the present invention are its convenience, ease of use, timesavings, energy-savings, durability, lightweight, compact size, novel design, practicality, an effectiveness. The cape keeps a client warm and comfortable while receiving hairstyling services. The present invention allows a client to have peace of mind knowing that he or she will stay warm and comfortable while hair was shampooed, rinsed, colored, permed, ect. Client would not develop chill when sitting for long periods of time during hairstyling deride. The present invention serves as an effective alternate to using traditional capes. The present invention contributes to greater customer satisfaction and increases revenues by the establishment. Clients will feel pampered with the use of the cape and salon owners can provide a better service and comfort for their clients. Clients often spend a long time sitting, as their hair is being cut or colored when they visit their salon. The present invention is convenient, novel in design, effective, soft, breathable, washable, durable for years of effective use, practical, and easy to use.

Figure 1:
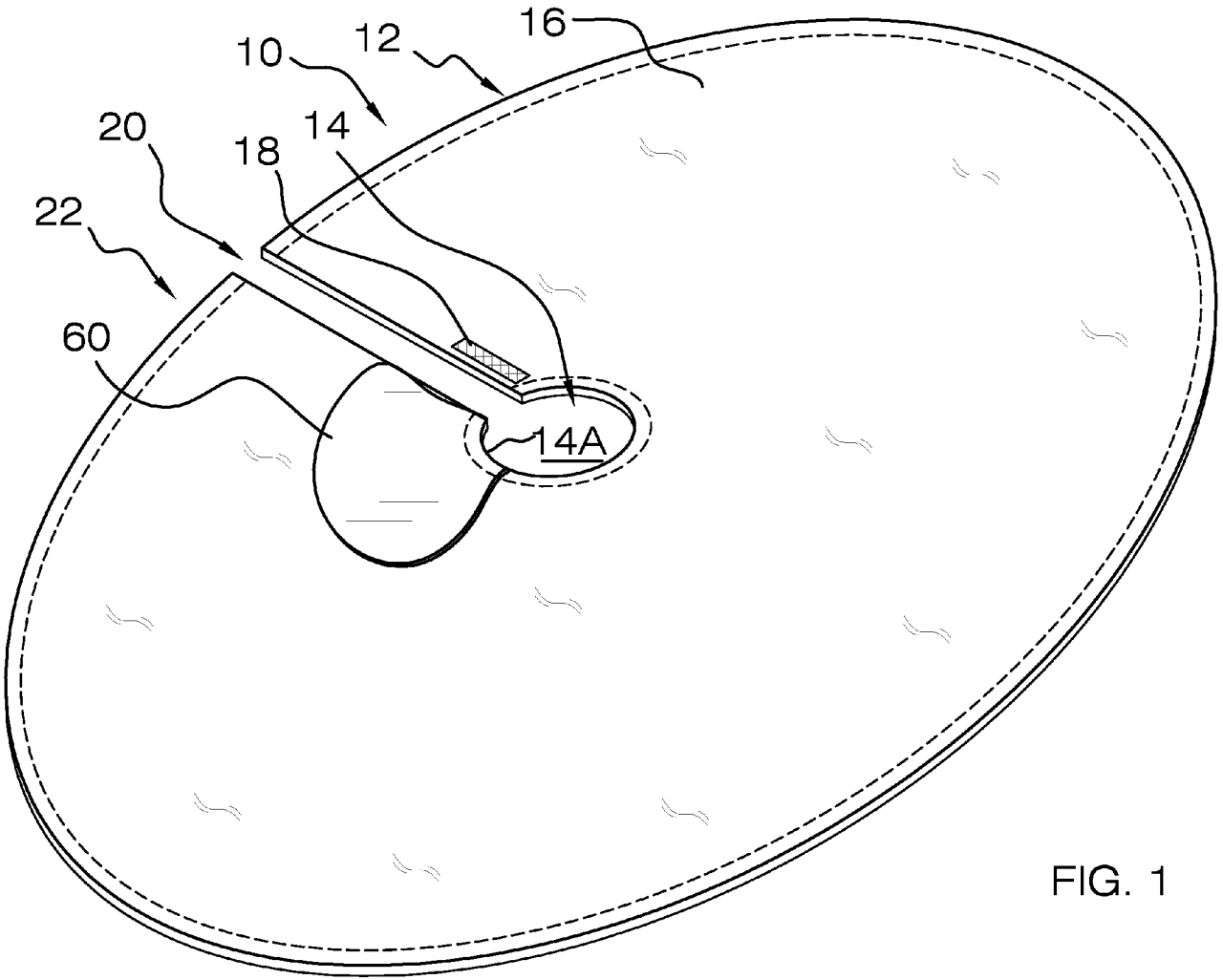
FIG. 1 is a perspective view of the top side of the present invention thermal layer insulated cape.
Figure 2:
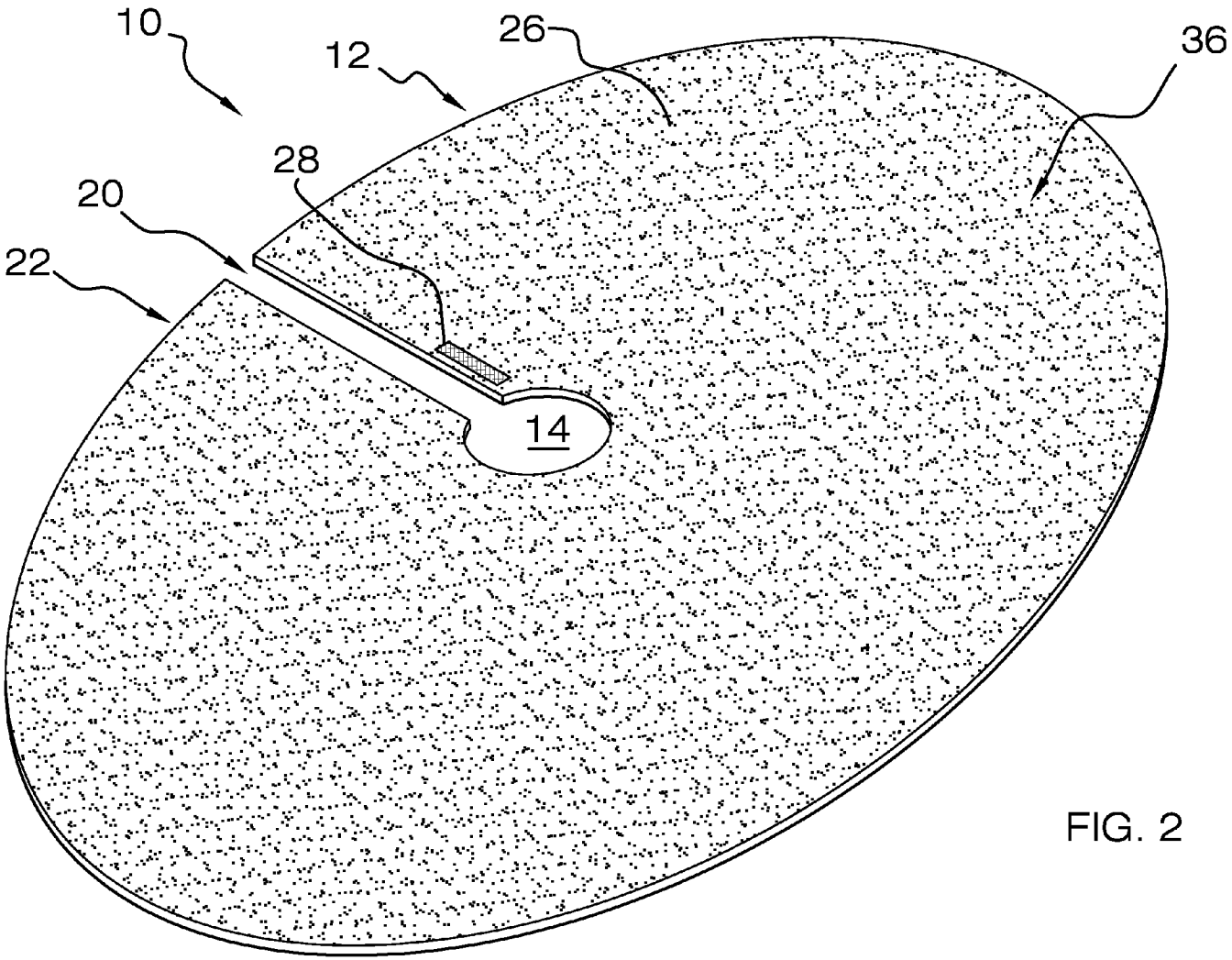
FIG. 2 is a perspective view showing the underside of the present invention thermal layer insulated cape.

Referring initially to FIG. 1, wherein a perspective view of the topside of the present invention thermal layer insulated cape 10 is shown. The cape 10 has a cape body 12 of substantially circular or elongated circular shape. A suitable dimension of the cape body 12 is about 60 inches long and 54 inches wide in an oval shape, or can be between about 54-60 inches in diameter when the cape body 12 is in a circular shape.

Figure 4:
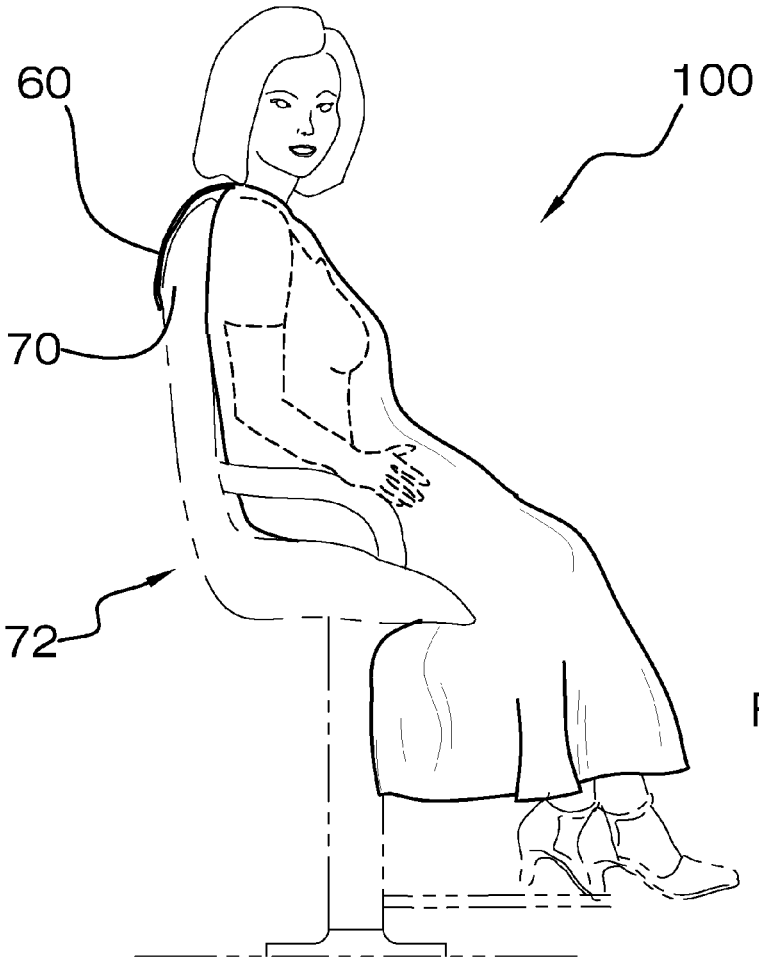
FIG. 4 is an illustration showing how the present invention thermal layer insulated cape is utilized.

The cape body 12 is provided with a center aperture 14 for fitting around the user's neck, such as the user 100 shown in FIG. 4. The center aperture 14 is further provided with a slot opening 20 from the aperture 14 to an edge 22 of the cape body 12. The slot opening 20 allows the cape body 12 to be wrapped around a user's body, such as that shown in FIG. 4.

A top surface 16 of the cape body 12 is formed of a water impermeable material, such as nylon or polyurethane. A first fastener 18 of the hook-and-loop type is attached to the top surface 16 of the cape body 12 located immediately adjacent to the slot opening 20.

A bottom surface 26 for the cape body 12 of the cape 10 can be formed of a thermal insulating material, such as suitably a naturally occurring material like cotton. A second fastener 28, which may also be of the hook-and-loop type for matingly engaging with the first fastener 18 is attached to the bottom surface 26 immediately adjacent to the slot opening 20.

Figure 3:
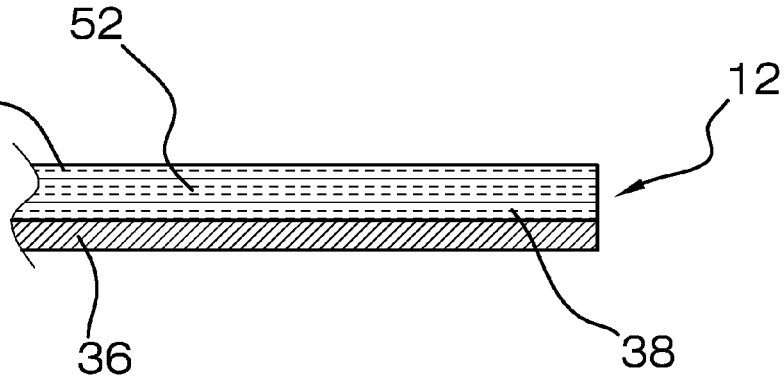
FIG. 3 is an enlarged, partial cross-sectional view of the present invention cape material.

A partially enlarged, cross-sectional view of the present invention cape body 12 is shown in FIG. 3. The thermal layer 36 forms the bottom surface of the cape body 12 for contacting the user's body and providing warmth to user 100, shown in FIG. 4. The thermal layer 36 is attached to a substrate layer 38 which can be formed of any suitable material. The substrate layer 38 is then bonded to the top layer 48 of water impermeable material by an adhesive layer 52. The adhesive layer 52 may not also be necessary when the water impermeable layer maybe fusion bonded to the substrate layer 38.

A flap body 60, shown in FIGS. 1 and 4 is further provided on the present invention cape body 12. The flap body maybe suitably formed either in a circular or an oval shape that is connected to the edges 14*a* of the center aperture 14 and extends away from the center aperture 14. The sides of the flap body may be suitably large enough to cover both shoulders of the user 100. The flap body 60 maybe formed of the same water impermeable material that is easily cleanable by wiping it down. The function of the flap body is to the catch debris during a hair care procedure. As clearly shown in FIG. 4, the flap body hangs over the seat back 70 of the barber chair 72. A suitable size for the flap body 60 maybe at least 12 inches in diameter, or more desirably, at least 18 inches in diameter when the flap body 60 has a circular shape.

The present invention thermal layer insulated cape has therefore been amply described in the above descriptions and in the appended drawings of FIGS. 1-4.

While the preferred embodiments of the invention have been described above, it will be recognized and understood that various modifications can be made in the invention and the appended claims are intended to cover all such modifications which may fall within the spirit and scope of the invention.

What is claimed is:

1. A thermal layer insulated cape comprising:

a cape body of substantially circular or elongated circular shape having a center aperture for fitting around a user's neck, a slot opening from said aperture to one edge of said cape body for wrapping around a user's body;

a top surface of said cape body formed of a water impermeable material, a substrate layer bonded to said top surface on a first surface, a first fastener attached to said top surface juxtaposed to a first side of said slot opening;

a bottom surface of said cape body formed of a thermal insulating material, said bottom surface bonded to a second surface opposite to said first surface of said substrate, a second fastener matingly engageable with said first fastener attached to said bottom surface juxtaposed to a second side of said slot opening for engaging said first fastener; and a flap body extending outwardly away from and connected to said aperture for catching debris during a hair-care procedure; said flap body having a size that is at least 12 inches in diameter.

2. The thermal layer insulated cape according to claim 1, wherein said flap body is fabricated of a water impermeable material.

3. The thermal layer insulated cape according to claim 1, wherein said flap body having a size that is at least sufficient to cover both shoulders of a user.

4. The thermal layer insulated cape according to claim 1, wherein said water impermeable material is nylon or polyurethane.

5. The thermal layer insulated cape according to claim 1, wherein said thermal insulating material is formed of a naturally occurring material.

6. The thermal layer insulated cape according to claim 5, wherein said naturally occurring material is cotton.

* * * * *